US010441845B2

(12) United States Patent
Moreno et al.

(10) Patent No.: US 10,441,845 B2
(45) Date of Patent: Oct. 15, 2019

(54) EXERCISE ASSEMBLY FOR SQUATS

(71) Applicant: MKH LLC, Glenview, IL (US)

(72) Inventors: Matthew Moreno, Antioch, IL (US); Kenneth Su Chua, Glenview, IL (US); Hunter Banks, Vernon Hills, IL (US); John Kutsch, Harvard, IL (US); Vincent Lackowski, Harvard, IL (US); Marla Moreno, Antioch, IL (US)

(73) Assignee: MKH LLC, Glenview, IL (US)

( * ) Notice: Subject to any disclaimer, the term of this patent is extended or adjusted under 35 U.S.C. 154(b) by 98 days.

(21) Appl. No.: 15/863,902

(22) Filed: Jan. 6, 2018

(65) Prior Publication Data

US 2019/0209890 A1 Jul. 11, 2019

(51) Int. Cl.

| | |
|---|---|
| ***A63B 23/04*** | (2006.01) |
| ***A63B 71/00*** | (2006.01) |
| ***A63B 21/062*** | (2006.01) |
| ***A63B 21/00*** | (2006.01) |

(52) U.S. Cl.

CPC ..... *A63B 23/0405* (2013.01); *A63B 21/0622* (2015.10); *A63B 21/0626* (2015.10); *A63B 21/4035* (2015.10); *A63B 21/4045* (2015.10); *A63B 71/0054* (2013.01); *A63B 2023/0411* (2013.01); *A63B 2209/00* (2013.01); *A63B 2225/093* (2013.01)

(58) Field of Classification Search

CPC ..... A63B 23/0405; A63B 2023/0411; A63B 21/4045; A63B 21/0622; A63B 21/0626; A63B 21/4033; A63B 21/4035; A63B 22/205

See application file for complete search history.

(56) References Cited

U.S. PATENT DOCUMENTS

| | | | | |
|---|---|---|---|---|
| 5,158,520 | A * | 10/1992 | Lemke | A63B 21/06 482/103 |
| 5,299,990 | A | 4/1994 | Mehlhoff | |
| 5,529,558 | A * | 6/1996 | Koenig | A63B 21/0615 482/137 |
| 7,247,128 | B2 * | 7/2007 | Oga | A63B 21/00181 297/DIG. 10 |
| 7,662,067 | B2 | 2/2010 | Payne | |
| 7,780,586 | B2 | 8/2010 | Gates | |
| 8,961,375 | B2 | 2/2015 | Henesey | |
| 9,259,604 | B2 * | 2/2016 | Miller, Jr. | A63B 21/068 |

(Continued)

*Primary Examiner* — Jennifer M Deichl

(74) *Attorney, Agent, or Firm* — Craft Chu PLLC; Andrew W. Chu

(57) ABSTRACT

The exercise assembly for squats includes a support frame, a foot plate, a seat member, a wall frame, an upright beam, and a trolley member. The support frame includes a base member, a base post, and a support arm. The seat member is placed relative to the support frame by the foot plate. The seat member is adjustable. The wall frame includes curved knee frame, a knee wall, and a horizontal support beam. The upright beam extends upward from the base member at an angle toward the seat member. The support arm connects the base member, the horizontal support beam, and the upright beam at an angle to allow performance of a squat in a proper and safe posture throughout the complete squatting movement. The trolley member slides along the upright beam so that the complete squatting movement tracks along the angle of the upright beam.

20 Claims, 3 Drawing Sheets

(56) References Cited

U.S. PATENT DOCUMENTS

| | | | | |
|---|---|---|---|---|
| 9,289,646 | B2 | 3/2016 | Tully | |
| 9,446,284 | B2 * | 9/2016 | Sela | A63B 21/15 |
| 2002/0065176 | A1 * | 5/2002 | LaFond | A63B 21/068 482/93 |
| 2006/0160676 | A1 * | 7/2006 | Sato | A63B 21/00181 482/94 |
| 2006/0000387 | A1 | 12/2006 | Rao et al. | |
| 2009/0082181 | A1 * | 3/2009 | Salvioli | A63B 21/159 482/114 |
| 2013/0324374 | A1 * | 12/2013 | Ellis | A63B 21/0615 482/97 |
| 2015/0026587 | A1 | 9/2015 | Sela | |
| 2017/0203149 | A1 * | 7/2017 | D'Amico | A63B 23/0405 |
| 2017/0225029 | A1 * | 8/2017 | Lin | A63B 21/159 |
| 2018/0036589 | A1 * | 2/2018 | Lin | A63B 21/068 |

* cited by examiner

EXERCISE ASSEMBLY FOR SQUATS

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to exercise equipment. More particularly, the present invention relates to exercise equipment for squats. Even more particularly, the present invention relates to exercise equipment to maintain safe and proper form of the user, while performing a squat.

2. Description of Related Art Including Information Disclosed Under 37 CFR 1.97 and 37 CFR 1.98

A squat is a basic compound exercise, which is incorporated into many exercise and fitness routines. Despite being so widely used in the field of physical fitness and strength, especially for leg workouts, the squat has frequently been associated with back and knee injuries. Maintaining proper form is a main consideration in order to avoid injuries.

Various patents and publications have disclosed inventions related to exercise machines for squats. U.S. Pat. No. 9,259,604, issued to Miller Jr. on 16 Feb. 2016, discloses an exercise machine for performing squats. The machine includes an angled beam and a handle assembly for motion along the beam during the squatting motion. There is a leg pad assembly adjustably attached to the upright member. The leg pad assembly and handle assembly are adjusted for each user. U.S. Pat. No. 8,961,375, issued to Henesey on 24 Feb. 2015, discloses another squat exercise apparatus. There is a platform with a hole and several guide rods to control movement of the user, during the squat. The guide rods to hold position of the knees are positioned to maintain the proper position of the user. US Patent Publication No. 2015/0265872, published for Sela on 24 Sep. 2015 was recently patented as U.S. Pat. No. 9,446,284 on 20 Sep. 2016. This device shows foot pads and blocking members to align the user and the knees of the user during a squat. The blocking members are rigid and prevent the user from leaning forward.

It is an object of the present invention to provide an exercise assembly for squats.

It is an object of the present invention to provide an exercise assembly to maintain proper form during a squat.

It is another object of the present invention to provide an exercise assembly with an angled upright vertical beam to stabilize body and posture.

It is another object of the present invention to provide an exercise assembly with a designated area between the seat and a knee wall.

It is another object of the present invention to provide an exercise assembly with a support frame with a single base beam to support an angled upright vertical beam.

It is still another object of the present invention to provide an exercise assembly with an adjustable handle.

These and other objectives and advantages of the present invention will become apparent from a reading of the attached specifications and appended claims.

BRIEF SUMMARY OF THE INVENTION

The exercise assembly allows a user to perform a squat with proper form and reduces risk of injury. The exercise assembly sets the initial posture of the user and maintains the correct posture during the complete squatting movement of the exercise. As the user raises and lowers, the body position is supported and set in a safe and proper form. The components of the exercise assembly include a support frame, a foot plate, a seat member, a wall frame, an upright beam, and a trolley member.

Embodiments of the present invention include the support frame having a base member, a base post and support arm. The base member has a distal base member end and a proximal base member end with the base post attached at the distal base member end and the support arm attached at the proximal base end. In this embodiment, the foot plate attaches to the base member at the proximal base member end.

The seat member is mounted on a back plate end of the foot plate and can include a seat adjustment means and seat body. The seat adjustment means raises and lowers the seat body of the seat member. Any known prior art adjustment means, such as a perforated plate and insertable pin, a spring-loaded lever pin and cooperative holes or an alternative compressed air mechanism, can raise and lower the seat body.

There is the wall frame extending from the foot plate and the upright beam attached to the base post of the base member. In some embodiments, the wall frame is comprised of curved knee frame, a knee wall, and a horizontal support beam connected to the support arm of the base member. The knee wall can have additional accessories for protection and support. Also, the upright beam extends upward from the base member at an angle toward the seat member.

The trolley member slides along the upright beam, according to the complete squatting movement of the squat by the user. The trolley member can be comprised of a trolley body, a handle adjustment means, a handle member, and a weight attachment means. The trolley body mounts around the upright beam, and the handle adjustment means fits to any user with any size arms to reach the handle member. The weight attachment means allows the user to add weight to the trolley for additional resistance for the squat.

In the present invention, the support arm connects to the upright beam member and the horizontal support beam at one end and connects to the base member at an opposite end. The base member and the horizontal support beam are parallel, while the support arm and the upright beam are both angled in order to support the angle of the upright beam. The upright beam member can extends 7-13 degrees from vertical upward from the base member and toward the seat member.

The trolley member is a moveable component of the exercise assembly.

The user moves the trolley member along the upright beam during the squat. The raising and lowering by the user corresponds to sliding the trolley member along the length of the upright beam. The angle of the upright beam, the knee wall, and the seat body maintain the proper posture of the user throughout the complete squatting movement. The trolley member can include an adjustable handle to account for different size users, and a weight attachment means to change the resistance during the squat.

The present invention includes the method of performing a squat with the exercise assembly. The method includes assembling the components of the exercise assembly, setting the seat member relative to the trolley member, setting the handle member relative to the seat member so as to set an initial rest position of the trolley member, actuating the trolley member from the initial rest position to an elevated position along the upright beam, lowering the trolley member from the elevated position to a lowered position down the upright beam, and repeating the step of actuating and the step of lowering. The method also includes adjusting the seat body, as well as adjusting the handle relative to the seat body, so as to accommodate users of different sizes.

DETAILED DESCRIPTION OF THE INVENTION

Figure 1:
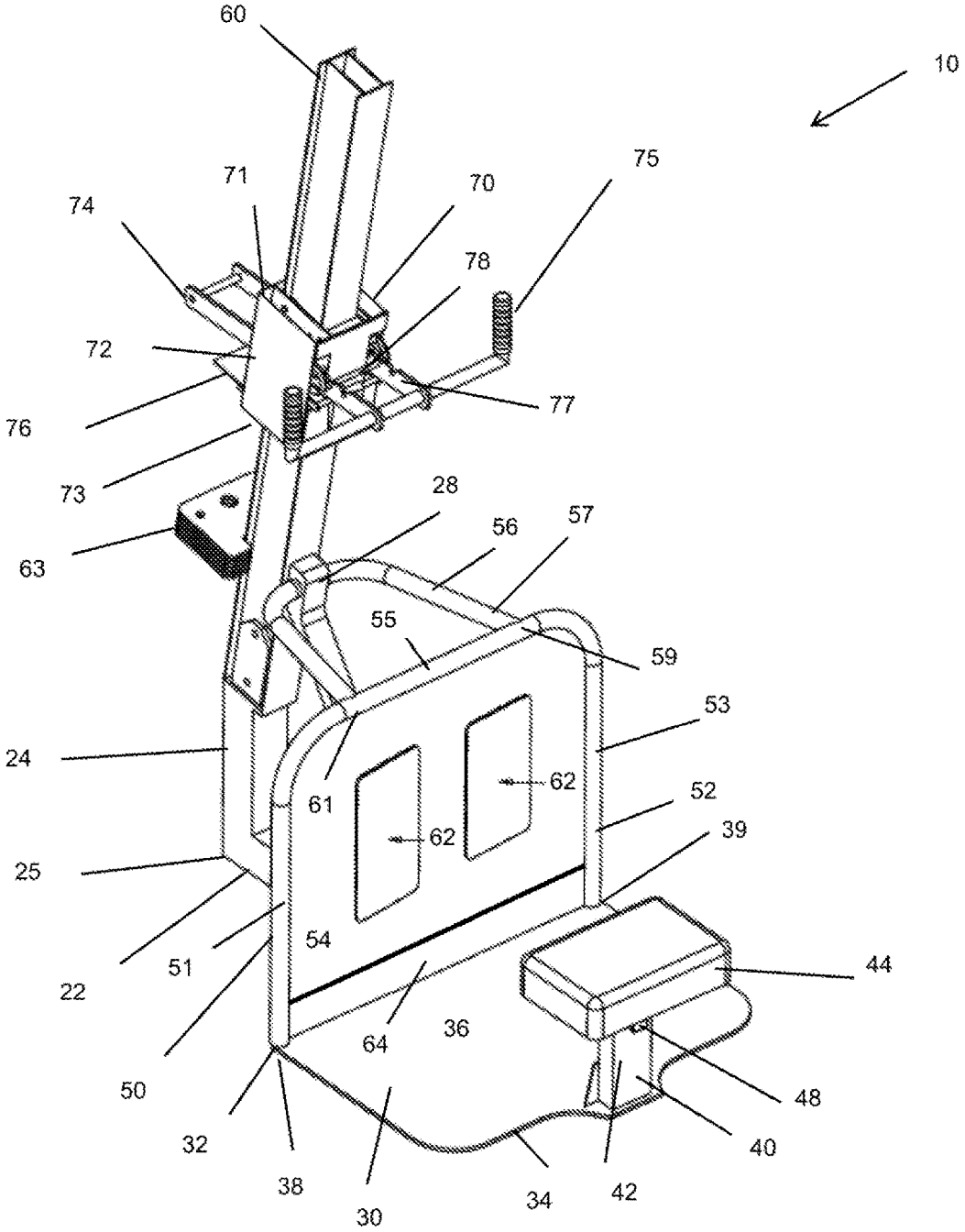
FIG. 1 is an upper rear perspective view of the exercise assembly of an embodiment of the present invention.

Maintaining proper form during the complete squatting movement prevents injury. The risk of damage to the back and knees can be reduced with guidance and repetition. The exercise assembly 10 of the present invention provides a structure to set the posture of a user and to maintain the proper form during the complete squatting movement. The components of the exercise assembly 10 include a support frame 20, a foot plate 30, a seat member 40, a wall frame 50, an upright beam 60, and a trolley member 70. The seat member 40 sets the lower limit for how low the user should squat, and trolley member 70 slides along the upright beam 60 to guide the complete squatting movement from the user lowering to rising. In the present invention, the upright beam 60 is set at an angle relative to the support frame 20 for maintain the proper form of the user.

Figure 2:
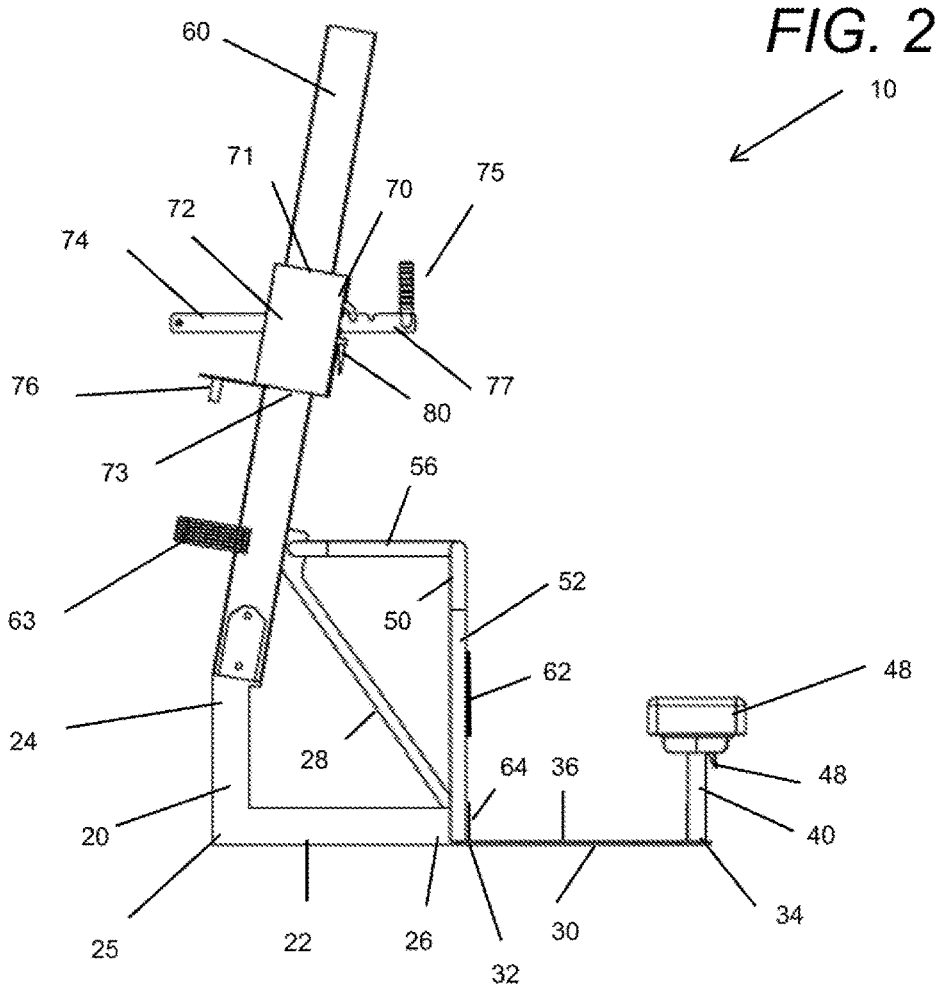
FIG. 2 is a side elevation view of the exercise assembly of an embodiment of the present invention.
Figure 5:
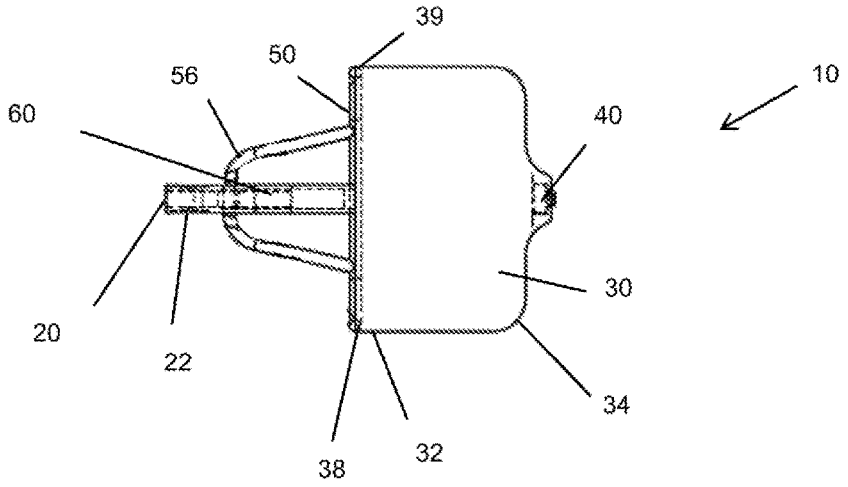
FIG. 5 is a bottom plan view of the exercise assembly of an embodiment of the present invention.

FIGS. 1,2, and 5 show the support frame 20 being comprised of a base member 22 having a distal base member end 24 and a proximal base member end 26. The distal base member end 24 is furthest from the seat member 40, and the proximal base member end 26 is closest to the seat member 40. The support frame also includes a base post 24 extending upward from the distal base member end 24, and a support arm 28 extending at a support arm angle from the proximal base member end 26. The support arm angle allows the support arm 28 to connect to the upright beam 60.

Embodiments of the invention also include the foot plate 30 attached to the base member 22 at the proximal base member end 26. The foot plate has a front plate end 32 and a back plate end 34 with the front plate end 32 facing the support frame 20. The proximal base member end 26 of the support frame 20 can be centered on the front plate end 32. FIGS. 1 and 2 show the foot plate 30 having a foot area 36 between the front plate end 32 and the seat member 40. This foot area 36 is flat to minimize any risk of tripping by the user. The front plate end 32 aligns with the wall frame 50. The wall frame 50 attaches to one side 38 of the front plate end 32 and an opposite side 39 of the front plate end 32.

Figure 3:
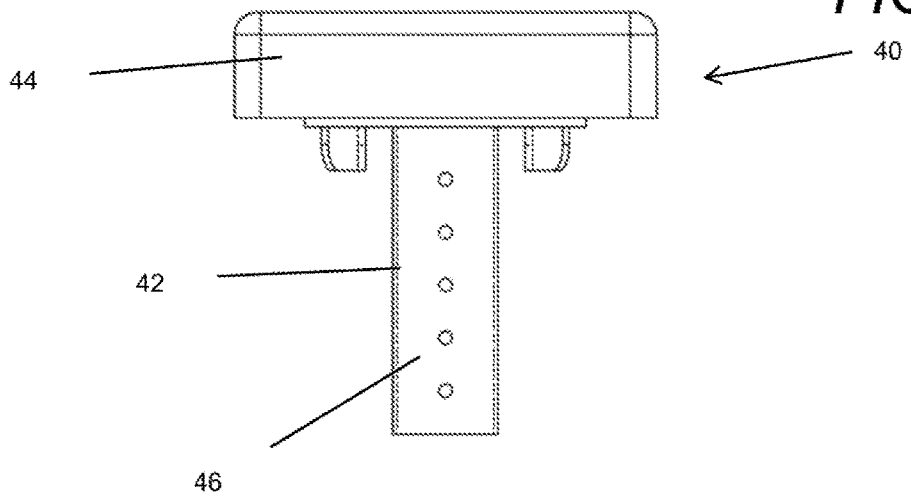
FIG. 3 is a side elevation view of the exercise assembly of a seat member of an embodiment of the present invention.

The seat member 40 is mounted on the back plate end 34 of the foot plate and includes a seat adjustment means 42 and seat body 44. The seat adjustment means 42 raises and lowers the seat body 44. In some embodiments, the seat adjustment means 42 can be comprised of a perforated plate 46 and an insertable pin member 48. FIG. 3 shows an embodiment of the seat adjustment means 42 comprised of the perforated plate 46 with holes. FIGS. 1-2 show the insertable pin member 48 activated by spring-loaded lever. The seat adjustment means 42 sets the seat member 40 in the proper place relative to the other components, such as the wall frame 50, and the support frame 20, and the seat adjustment means 42 provides a lower limit for how low to squat by the user. The seat member 40 insures that the lower limit of the squat is not exceeded. Although one embodiment shows the seat adjustment means 42 as the perforated plate 46 and insertable pin 48 with spring-loaded lever, other prior art assemblies, such as hydraulics and other actuated pins and stops to lock the seat body 44 after being raised and lowered are covered by the present invention. Within the scope of invention, the seat adjustment means 42 can also be a pin and hole device, spring loaded, peg, insert, and other prior art adjusters with variable movement of the seat body 44.

FIGS. 1, 2, and 5 also show the wall frame 50 extending from the front plate end 32 of the foot plate 30 and the upright beam 60 removably attached to the base post 24. The inter-relationships between the support frame 20, the wall frame 50, and the upright beam 60 allow the user to set the posture and keep the posture throughout the complete squatting movement. The wall frame 50 can be comprised of curved knee frame 52, a knee wall 54, and a horizontal support beam 56. The upright beam 60 extends upward from the base member 20 at an angle toward the seat member 40.

In some embodiments, the knee wall 54 is comprised of a plurality of knee pads 62 mounted facing the seat member 40 and a toe kick panel 64 set at a bottom of the knee wall. FIGS. 1 and 2 show the knee pads 62 and toe kick panel 64 attached by adhesive or mechanical fasteners to the knee wall 54. The knee wall 54 can be comprised of metal or other suitable rigid material to block the knees of a user. The knee pads 62 can be formed by foam, including anti-microbial foam or other anti-microbial composition. The knee pads 62 may contact the knees of the user, so there is a need for clean and durable material selection. The toe kick panel 64 may be made of metal or rigid materials to withstanding incidental contact from the feet of the user. In some versions, an ant-slip surface coating can be used to prevent the user from slipping against the panel 64.

The base post 24 of the support frame 20 extends upward at a right angle, wherein the support arm 28 extends at the support arm angle from the proximal base member end 26 away from the seat member 40 and toward the upright beam 60. The horizontal support beam 56 of the wall frame 50 also connects to the support arm 28 opposite the base member 22. Thus, the support arm 28 connects to the upright beam 60 and the horizontal support beam 56 at one end and connects to the base member 20 at an opposite end. The base member 20 and the horizontal support beam 56 are parallel in FIGS. 1 and 2. The stability of the upright beam 60 is set by the support frame 20 and the wall frame 50, even though the upright beam 60 is angled toward the seat member 40 and the support arm 28 is at the support arm angle.

FIGS. 1-2 show embodiments of the curved knee frame 52 being comprised of a tubular member bent to extend from one side 38 of the front plate end 32, upward to the horizontal support beam 56, and downward to an opposite side 39 of the front plate end 32. FIGS. 1-2 show the curved knee frame 52 with a top portion 55, a first portion 51 and a second portion 53. There can be unitary construction of the first portion 51, top portion 55, and second portion 53 of the curved knee frame 52 or the tubular member can be assembled in parts. In this embodiment, the horizontal support beam 56 is also comprised of a tubular member, in particular, a U-shaped tubular member 57 extending from the curved knee frame 52 to the support arm 28 and back to the curved knee frame 52. For this horizontal support beam 56 as comprised of a U-shaped tubular member 57 extending from the curved knee frame 52 to the support arm 28, the U-shaped tubular member 57 has a first end 61 attached to the top portion 55 and a second end 59 attached to the top portion 55. The knee wall 54 spans the curved knee frame 52 so that the user must remain behind the wall frame 50. The knee wall 54 forces the user to squat with the user's knees behind the wall frame 50, and the seat member 40 prevents the user from squatting too low.

For the upper body, the upright beam member 60 extends 7-13 degrees from vertical upward from the base member 20 at the angle toward the seat member 40. In some embodiments, the upright beam 60 pivots from the base post 24 of the base member 20, as in FIGS. 1-2. In that particular embodiment, the upright beam member 60 extends 10 degrees from vertical. With the lower body of the user maintained and guided by the knee wall 54 and the seat member 20, the upper body of the user aligns the complete squatting movement along the upright beam 60. The exercise assembly 10 addresses both upper and lower body posture and form.

Figure 4:
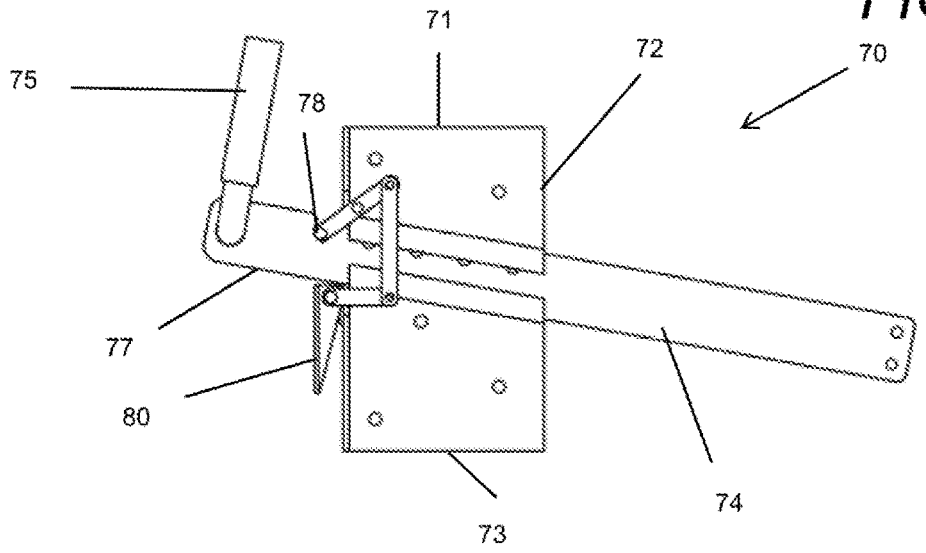
FIG. 4 is a side elevation view of the exercise assembly of a trolley member of an embodiment of the present invention.

The trolley member 70 itself slides along the upright beam 60 as lifted and lowered by the user. The trolley member 70 slidably engages the upright beam 60 in a tracked relationship, which allows for repetition of the complete squatting movement. FIGS. 1, 2, and 4 show embodiments of the trolley member 70 being comprised of a trolley body 72, a handle adjustment means 74, a handle member 75, and weight attachment means 76. The trolley body 72 has a top end 71 and a bottom end 73 aligned with the top and bottom of the upright beam 60. FIG. 2 shows the weight attachment means 76 connected to the bottom end 73. The weight attachment means 76 can include a rack with removable weights, a rod for mounting weights with holes, a peg and insert device for connecting weights to the trolley or storing weights on a lower end of the upper beam 60. FIGS. 1 and 2 show the stack of weights 63 stored on the upright beam 60. The rod or hook of the weight attachments means 76 can attach these weights. Any known structure to hold weights can be adapted for compatibility with the exercise assembly 10 of the present invention.

FIGS. 1 and 5 show embodiments of the handle adjustment means 74.

Again, any known structure of an adjustable handle can be adapted for compatibility with the exercise assembly 10 of the present invention. In one embodiment, the handle adjustment means 74 is comprised of a grooved rack 77 and an actuatable lock bar 78. The handle member 75 can be grasped by the user during the complete squatting movement and to set the initial position of the trolley member 70 before starting a squat. The grooved rack 77 positions the handle member 75 at different distances relative to the upright beam 60 in order to account for different arm lengths of the different users. Any size user can use the exercise assembly 10 with changes to the seat member 20 and the trolley member 70. FIG. 4 shows the handle adjustment means 74 further comprising a spring-loaded pull lever 80. The handle adjustment means 74 extends from and/or through the trolley member 70 with a range of motion parallel to the horizontal support beam 56. In other embodiments, the handle adjustment means 74 can be a protrusion and grooved rack. The grooved rack is horizontal and various supports hold the horizontal orientation, even when mounted to the upright beam 60, which is angled. Other adjustment devices include a spring loaded pin and perforated board, and a spring-loaded pull lever. The handle adjustment means 74 must adjust the handle member 75 relative to the trolley body 70 and the seat member 40. To accommodate the upright beam, there are supports to hold the horizontal orientation of the handle adjustment means 74.

Embodiments of the present invention include the method for performing a squatting exercise with the exercise assembly 10. In this method, the seat member 20 is set relative to the trolley member 70 in order to set the lower limit of the squat and to accommodate the size of the user. Then, the handle member 75 is set relative to the seat member 40, according to arm length of the user. These changes set an initial rest position of the trolley member 70 and the rest position of the user in the proper posture. The trolley member 70 can be actuated from the initial rest position to an elevated position along the upright beam 60 by the user in a raising action with the back, legs, and glutes. The trolley member can be lowered from the elevated position to a lowered position down the upright beam 60 as the other half of the rep. The knees of the user remain behind the knee wall 54 through actuating and lowering, and the upper body holds the handle member 75 of the trolley member 70 to keep the upper body in alignment with the upright beam 60. The step of actuating and the step of lowering are repeated for each rep of the squat, and the trolley member 70 is returned to the initial rest position, so that the user can exit the exercise assembly 10 safely.

The step of setting the seat member includes raising and lowering the seat body 44 with the seat adjustment means 42. When the seat adjustment means 42 is an insertable pin 48 with a spring-loaded lever and perforated plate 46 with holes or and any other prior art mechanism to raise and lower the seat body, the step of setting the seat member comprises releasing the seat body with the seat adjustment means, moving the seat body, and resetting the seat adjustment means so as to lock the seat body.

Similarly, when the handle adjustment means 74 is comprised of a grooved rack 77, an actuatable lock bar 78, and a spring-loaded pull lever 80 connected to the actuatable lock bar 78, the step of setting the handle member 75 includes positioning the handle member 75 at different distances relative to the upright beam 60. The handle adjustment means 74 can also be a protrusion and grooved rack, spring loaded pin and perforated board, a spring-loaded pull lever adjustment and handle bar extended through the trolley body. The step of setting the handle member 75 can be further comprised of releasing the spring-loaded pull lever 80, separating the actuatable lock bar 78 from the grooved rack 77, moving the handle member 75 and the grooved rack 77 to a new position relative to the trolley member 70 and seat member 20, and resetting the actuatable lock bar 78 into the grooved rack 77 at a different spot on the grooved rack. The handle member 75 is now locked, after the step of moving the handle member 75. The new position is customized for the particular user of the exercise assembly 10.

The present invention provides an exercise assembly for squats. The exercise assembly maintains proper form during a squat in order to reduce the risk for injury. There is an angled upright beam to align the upper body. The upright beam stabilizes body and posture throughout the complete squatting movement. The trolley member of the invention is grasped by the user and slides along the upright beam so that the back of the user repeats the angled vertical movement, while maintaining correct posture. The handle to the trolley member is adjustable to account for any size user. Additionally, the exercise assembly includes a seat member and wall frame to align the lower body. The seat member prevents the user from squatting too low, which reduces the risk of a back injury. The seat member can also be adjusted to account for the size of the user and ability level of the user. The wall frame includes a knee wall to align the knees of the user. With the knees aligned behind the knee wall, the lower body remains in the correct posture during the complete squatting movement. Additionally, there is a designated area between the seat member and a knee wall. The designated area is flat and remains clear to reduce the risk of tripping and falling in the exercise assembly. In some embodiments, there is a support frame with a single base member. The single base member no longer requires braced supports in a triangular form to support the exercise assembly. Thus, the lack of braced supports also reduces the risk of tripping and falling. The present invention avoids the straight vertical movement to maintain the proper posture throughout the complete squatting movement. The structures align with different parts so that the user is forced to maintain correct posture.

The foregoing disclosure and description of the invention is illustrative and explanatory thereof. Various changes in the details of the illustrated structures, construction and method can be made without departing from the true spirit of the invention.

We claim:

1. An exercise assembly, comprising:

a support frame being comprised of a base member having a distal base member end and a proximal base member end, a base post extending upward from said distal base member end, and a support arm extending at an angle from said proximal base member end;

a foot plate attached to said base member at said proximal base member end, said foot plate having a front plate end and a back plate end, said proximal base member end being centered on said front plate end;

a seat member mounted on said back plate end of said foot plate, said seat member being comprised of a seat adjustment means and a seat body;

a wall frame extending from said front plate end of said foot plate, said wall frame being comprised of a curved knee frame, a knee wall, and a horizontal support beam, said horizontal support beam being connected to said support arm opposite said base member;

an upright beam removably attached to said base post and extending upward from said base member at an angle toward said seat member; and a trolley member slidably engaged along said upright beam, said trolley member being comprised of a trolley body, a handle adjustment means, a handle member, and weight attachment means.

2. The exercise assembly, according to claim 1, wherein said base post extends upward at a right angle, wherein said support arm extends at said angle from said proximal base member away from said seat member and toward said upright beam member.

3. The exercise assembly, according to claim 2, wherein said support arm connects to said upright beam member and said horizontal support beam at one end and connects to said base member at an opposite end.

4. The exercise assembly, according to claim 2, wherein said base member and said horizontal support beam are parallel.

5. The exercise assembly, according to claim 1, wherein said foot plate is further comprised of a foot area between said front plate end and said seat member.

6. The exercise assembly, according to claim 5, wherein said front plate end corresponds to said wall frame, said wall frame attaching to one side of said front plate end and an opposite side of said front plate end.

7. The exercise assembly, according to claim 1, wherein said seat adjustment means is comprised of a perforated plate and an insertable pin member.

8. The exercise assembly, according to claim 1, wherein said curved knee frame is comprised of a tubular member bent to extend from one side of said front plate end, upward to said horizontal support beam, and downward to an opposite side of said front plate end.

9. The exercise assembly, according to claim 1, wherein said horizontal support beam is comprised of a U-shaped tubular member extending from said curved knee frame to said support arm.

10. The exercise assembly, according to claim 8, wherein said curved knee frame is comprised of a top portion, a first portion and a second portion.

11. The exercise assembly, according to claim 10, wherein said horizontal support beam is comprised of a U-shaped tubular member extending from said curved knee frame to said support arm, said U-shaped tubular member has a first end attached to said top portion and a second end attached to said top portion.

12. The exercise assembly, according to claim 1, wherein said upright beam member extends 7-13 degrees from vertical upward from said base member at said angle toward said seat member, and wherein said support arm connects to said upright beam member and said horizontal support beam at one end and connects to said base member at an opposite end.

13. The exercise assembly, according to claim 1, wherein said upright beam member extends 10 degrees from vertical upward from said base member at said angle toward said seat member, said upright beam member pivoting from said base post, and wherein said support arm connects to said upright beam member and said horizontal support beam at one end and connects to said base member at an opposite end.

14. The exercise assembly, according to claim 1, wherein said trolley body has a top end and a bottom end, and wherein said weight attachment means connects to said bottom end.

15. The exercise assembly, according to claim 1, wherein said handle adjustment means is comprised of a grooved rack and an actuatable lock bar so as to position said handle member at different distances relative to said upright beam.

16. The exercise assembly, according to claim 15, further comprising a spring-loaded pull lever connected to said actuatable lock bar.

17. The exercise assembly, according to claim 15, said handle adjustment means extending through said trolley member with a range of motion parallel to said horizontal support beam.

18. A method for performing a squat, the method comprising the steps of:

forming an exercise assembly, according to claim 1;

setting said seat member relative to said trolley member;

setting said handle member relative to said seat member so as to set an initial rest position of said trolley member;

actuating said trolley member from said initial rest position to an elevated position along said upright beam;

lowering said trolley member from said elevated position to a lowered position down said upright beam; and repeating the step of actuating and the step of lowering.

19. The method for performing a squat, according to claim 18, wherein the step of setting said seat member further comprises:

releasing said seat body with said seat adjustment means;

moving said seat body; and resetting said seat adjustment means so as to lock said seat body.

20. The method for performing a squat, according to claim 18, wherein said handle adjustment means is comprised of a grooved rack, an actuatable lock bar and a spring-loaded pull lever connected to said actuatable lock bar, and wherein the step of setting said handle member relative to said seat member so as to set an initial rest position of said trolley member comprises:

releasing said spring-loaded pull lever so as to separate said actuatable lock bar from said grooved rack;

moving said handle member and said grooved rack; and resetting said actuatable lock bar into said grooved rack so as to lock said handle member after the step of moving said handle member.

* * * * *